United States Patent [19]

Murphy et al.

[11] 4,000,340

[45] Dec. 28, 1976

[54] CLOTHES DRYER ADDITIVE CONTAINING CRISPING AGENTS

[75] Inventors: Alan Pearce Murphy, Cincinnati; Fred Martin Habermehl, III, Loveland, both of Ohio

[73] Assignee: The Procter & Gamble Company, Cincinnati, Ohio

[22] Filed: Nov. 19, 1973

[21] Appl. No.: 417,329

Related U.S. Application Data

[63] Continuation-in-part of Ser. No. 410,596, Oct. 29, 1973, abandoned.

[52] U.S. Cl. ..... 428/35; 252/8.6; 252/8.9; 428/260; 428/272; 428/274; 428/289; 428/290; 428/304; 428/411; 428/530; 428/537; 428/540

[51] Int. Cl.[2] ..... D06M 13/00

[58] Field of Search ..... 252/8.6, 8, 9; 428/260, 428/272, 274, 289, 290, 304, 540, 35, 537, 411, 530

[56] References Cited

UNITED STATES PATENTS

| | | | |
|---|---|---|---|
| 3,632,396 | 1/1972 | Perez-Zamora | 252/8.6 |
| 3,650,816 | 3/1972 | Rudy | 252/8.6 |
| 3,686,025 | 8/1972 | Morton | 252/8.6 |
| 3,870,145 | 3/1975 | Mizuno | 252/8.6 |

*Primary Examiner*—Marion E. McCamish
*Attorney, Agent, or Firm*—Jerry J. Yetter; Charles R. Wilson; Richard C. Witte

[57] ABSTRACT

Applying water-insoluble, high melting alcohols, carboxylic acids or carboxylate salts to fabrics in an automatic clothes dryer provides a desirable crisp feel thereto.

7 Claims, No Drawings

CLOTHES DRYER ADDITIVE CONTAINING CRISPING AGENTS

CROSS-REFERENCE TO RELATED APPLICATION

This application is a continuation-in-part of application Ser. No. 410,596, filed Oct. 29, 1973, now abandoned.

BACKGROUND OF THE INVENTION

The present invention encompasses fabric treatment compositions adapted for use in an automatic dryer. More specifically, the compositions herein comprise a fabric treating agent such as an alcohol, carboxylic acid or carboxylate salt which provides a novel, crisp feel to fabrics. The fabric treating agents are preferably employed in combination with an oil-soluble surfactant.

The treatment of fabrics in an automatic clothes dryer has been recently shown to be an effective means for imparting desirable tactile properties to fabrics. For example, it is becoming common to soften fabrics in an automatic clothes dryer rather than during the rinse cycle of a laundering operation.

Fabric "softness" is an expression well-defined in the art and is usually understood to be that quality of the treated fabric whereby its handle or texture is smooth, pliable and fluffy, and not rough or scratchy to the touch. Certain chemical compounds have long been known in the art to posses the ability to soften fabrics in laundering operations.

The use of fabric softening compounds in compositions designed for application in automatic dryers has been the subject of recent innovations, as noted above. (See, for example, U.S. Pat. Nos. 3,632,396 and 3,686,025.) While the above-referenced patents and the prior art disclose materials which are effective as through-the-dryer fabric softeners, softness is but one member of a spectrum of tactile impressions which can be imparted to fabrics.

Fabric "crispness" is another desirable quality which is easily recognized when comparing old and new fabrics. Indeed, aqueous solutions and emulsions of various fabric sizing materials are specifically designed to provide a crisp fabric feel. For example, it is known that "scrooping" agents such as fatty alcohols can be applied to fabrics from aqueous emulsions to provide a crispness aspect; see Speel and Schwartz "Textile Chemicals and Auxiliaries" Reinhold, 1954, pp. 119–120. Softeners comprising 1,2-alkanediols have been applied to fabrics from aqueous liquors; see U.S. Pat. No. 3,766,062.

While the prior art has suggested various fabric treatment compositions and methods, the present invention provides compositions and methods specifically adapted to imparting novel sensory properties to fabrics dried in automatic dryers. Briefly, the present compositions and processes provide not only fabric softness, but also a fabric crispness aspect suggestive of fabric renewal. Remarkably, this fabric crispness is not in replacement of softeness, but is complemental thereto. While fabric softness and fabric crispness are subjective tactile impressions, these properties are readily discernible in fabrics treated in the manner of the present invention, and are especially notable on cotton fabrics such as terry towels and sheets.

Moreover, by the practice of the present invention it is possible to provide fabric finishes which are slowly transferred to the surface of the skin. By proper selection of the fabric crisping components herein, the finished fabrics provide desirable emolliency benefits to skin which is in contact therewith.

It is an object of the present invention to impart a novel crispness property to fabrics in an automatic dryer.

It is a further object of the present invention to provide articles of manufacture adapted for use in an automatic dryer to provide a crispness aspect to fabrics.

It is a further object of the present invention to provide compositions and processes which impart desirable skin conditioning properties to fabrics.

These and other objects are obtained herein as will be seen from the following disclosures.

SUMMARY OF THE INVENTION

In its broadest compositional aspect, the present invention encompasses a fabric crisping component and an oil-soluble surfactant. The fabric crisping component must be substantially water-insoluble and non-hygroscopic, as well as being solid under reasonable climatic temperature conditions. The foregoing characteristics insure that a clean, crisp feel, rather than an undesirable, tacky sensation, is imparted to the fabrics. Moreover, the crisping component herein preferably melts at dryer temperatures. The oil-soluble surfactant insures that the compositions are evenly and thoroughly coated over the fabric surfaces in an automatic dryer.

In a convenient embodiment, the compositions herein are provided in combination with a dispensing means designed for use in an automatic dryer.

The invention also encompasses a process for imparting novel crispness characteristics to fabrics.

The fabric conditioning composition of this invention comprises:

a. a substantially water-insoluble fabric crisping component selected from the group consisting of alcohols, carboxylic acids, carboxylic acid salts, and mixtures thereof, said crisping component having a melting point of at least about 38° C; and b. an oil-soluble surfactant component; wherein said crisping component is co-present with said surfactant component at a weight ratio of from about 1000:1 to about 1:1. The mixture melting point of the combination of said crisping component and said surfactant component is also preferably at least about 38° C.

The foregoing composition can be applied to wet fabrics in any convenient manner, e.g., sprinkled on, and said fabrics dried in an automatic dryer as disclosed hereinafter to provide a novel, crisp fabric finish.

The above composition can be provided in a form which is especially convenient for use in an automatic dryer. Accordingly, the invention encompasses an article of manufacture adapted for use in an automatic dryer, comprising:

a. a fabric conditioning composition comprising:

i. a substantially water-insoluble fabric crisping component selected from the group consisting of alcohols, carboxylic acids, carboxylic acid salts, and mixtures thereof, said crisping component having a melting point of at least 38° C; and ii. an oil-soluble surfactant component, wherein said fabric crisping component is co-present with said surfactant component at a weight ratio of from about 1000:1 to about 1:1 (again, the mixture melting point of the combination of said crisping component and said surfactant component is preferably at least about 38° C); and b. a dispensing means for releasing an effective amount of said fabric conditioning composition at automatic dryer operating temperatures, i.e., usually at temperatures of from about 38° C to about 80° C.

In its processing aspect, the invention constitutes a process for imparting fabric crispness in an automatic dryer, comprising:

a. combining wet fabrics with an effective amount of a water-insoluble fabric crisping component selected from the group consisting of alcohols, carboxylic acids, carboxylic acid salts, and mixtures thereof, said crisping component having a melting point of at least 38° C; and b. operating said automatic dryer at a temperature sufficient to melt said fabric crisping component and to dry said fabrics.

The term "effective amount" as used to describe the amount of crisping component employed herein means an amount sufficient to provide a crisp feel to fabrics. The amount of crisping component used can vary with the desires of the user, inasmuch as a spectrum of tactile impressions ranging from slightly crisp to markedly crisp (yet, not stiff) can be obtained, depending on the quantity of crisping agent applied per unit area of cloth. For most purposes the compositions herein are applied at a rate of about 100 mg/yd$^2$ to about 5000 mg/yd$^2$ of fabric.

The fabric conditioning compositions of the present invention can also contain various optional components which provide desirable modifications to the crispness aspect. Moreover, other fabric treatment materials such as antistatic agents, as well as perfumes, germicidal agents, and the like, can be present in minor proportions.

DETAILED DESCRIPTION OF THE INVENTION

The compositions herein comprise multiple ingredients, each of which are discussed, in turn, below.

Fabric Crisping Component

When employed in an automatic clothes dryer, the fabric crisping component of the compositions herein imparts the tactile impression of crispness to the finally dried fabrics. The term crispness as used herein means a distinctive tactile impression best described as dry and, in some cases, crunchy. The fabric crispness properties achieved by the present compositions provide an added dimension to fabric softeness, as it is generally understood. Crisp, soft fabrics can not be obtained without the undesirable excess lubricity and greasiness associated with fabric softeners heretofore employed.

Useful fabric crisping components of this invention encompass substantially water-insoluble compounds selected from the group consisting of alcohols, carboxylic acids, carboxylic acid salts, and mixtures of these compounds. By "substantially water-insoluble" herein is meant a water solubility of 1% by weight, or less, at 30° C. The alcohols are preferred for use herein by virtue of their excellent fabric crisping properties. Moreover, alcohol from the treated fabrics can be slowly transferred to skin on contact with the fabric to provide prolonged emolliency benefits. Mono-ols, di-ols and poly-ols having the requisite melting points and water-insolubility properties set forth above are useful herein, but the mono-ols are preferred in that they are non-hygroscopic and non-tacky when applied to fabrics.

As will be seen hereinafter, all manner of water-insoluble, high melting alcohols, carboxylic acids and carboxylate salts are useful as the fabric crisping component herein, inasmuch as all such materials coat fibers and dry to a relatively stiff, non-tacky fabric finish. Of course, it is desirable to use fabric crisping components which are colorless, so as not to alter the color of the fabrics being treated. Toxicologically acceptable materials which are safe for use in contact with skin should be chosen for use.

Alcohols

Primary, secondary and tertiary alcohols are all useful as the crisping component of the present compositions. The hydrocarbyl moiety of the alcohol can be alkyl, olefinic, acetylenic or multiple unsaturated alkyl, cycloalkyl, heterocyclic, aralkyl, e.g., phenylalkyl, and the like. Aryl alcohols, i.e., the phenolics, provide the fabric crispness benefits herein but are not preferred when treated fabrics are to be in contact with skin for prolonged periods. In short, any alchohol having the requisite water-insolubility and high melting point range is useful herein.

For example, iso-propyl alcohol, a common secondary aliphatic alcohol, is not useful as the fabric crisping component herein due to its low melting point and high water solubility. In contrast, 2-heptadecanol, another common secondary alcohol, is useful herein by virtue of its low water solubility and high melting point.

Many highly substituted alcohols are known to be water-insoluble and to have a high melting points, and these are also useful herein. For example, although methanol is not useful herein because of its low melting point and high water solubility, 4-methyl benzyl alcohol is useful.

Alcohols and mixtures thereof with melting points below about 38° C are not useful herein. Only those alcohols which are solid or substantially solid at climatic temperatures commonly encountered are employed in the present compositions. Liquid (low melting) alcohols can be applied to fabrics to increase lubricity, but the solid (high melting) alcohols provide the desired fabric crispness.

Alcohols employed as the fabric crisping component herein are preferably those which have melting points of from about 45° C to about 65° C, i.e., at temperatures within the range commonly encountered in a typical automatic clothes dryer. A melting point within this dryer operating range insures that, in use, the alcohols are fluidized and are more efficiently transferred and deposited uniformly on the fabric surface. After the drying operation, the alcohol cools and solidifies to crisp the fabric. Alcohols melting above dryer temperatures are useful herein, but are not as efficiently transferred to fabrics. Such extremely high melting alcohols can optionally be diluted with various adjunct materials, as described hereinafter, to lower their melting points to that encountered in a dryer.

In addition, the alcohols having melting points within the preferred range recited above are more easily transferred from the treated fabric to human skin through mechanical friction and body heat to provide desirable emolliency benefits. Such considerations are important when an alcohol such as cetyl alcohol, which is known to be a skin emollient, is employed as the crisping component of this invention.

A preferred class of alcohols useful herein includes the higher melting members of the so-called fatty alcohol class. Although once limited to alcohols obtained from natural fats and oils, the term fatty alcohols has come to means those alcohols which correspond to the alcohols obtainable from fats and oils, and all such alcohols can be made by synthetic processes. Fatty alcohols prepared by the mild oxidation of petroleum products are useful herein.

All fatty alcohols are substantially water-insoluble and the $C_{14}$ to $C_{18}$ fatty alcohols have the preferred melting points for use herein. Moreover, the fatty alcohols are preferred from the overall standpoint of availability, low cost, low color, and toxicological acceptability. A further consideration is that many fatty alcohols are known to impart emollient benefits to the skin. The saturated $C_{14}$ to $C_{18}$ fatty alcohols are most highly preferred for use herein, inasmuch as the corresponding unsaturated alcohols can oxidize at dryer temperatures and undesirably yellow fabrics.

Table I sets forth typical alcohols which are useful as the crisping component of the present compositions, but is not intended to be limiting thereof.

TABLE I

| Alcohol | Melting Point °C |
|---|---|
| 1-Tricosanol | 74 |
| 1-Tetradecanol (myristyl alcohol) | 37.7 |
| 1-Pentadecanol | 44 |
| 1-Hexadecanol (cetyl alcohol) | 49.3 |
| 1-Heptadecanol | 54 |
| 1-Octadecanol (stearyl alcohol) | 59.5 |
| 1-Nonadecanol | 62 |
| 1-Eicosanol | 65 |
| 15-Methyl hexadecanol | 40.7 – 41.2 |
| 16-Methyl heptadecanol | 40.1 – 40.3 |
| 1-Heneicosanol | 69.5 |
| 1-Docosanol | 73.5 |
| 2-Octadecanol | 52 |
| 2-Nonadecanol | 52 |
| 2-Eicosanol | 60 |
| 2-Hexadecanol | 44 |
| 2-Heptadecanol | 44.5 |
| Tallowalkyl alcohol (mixture) | 46 – 47 |
| 1,1-Diphenyl hexadecanol | 47 – 48 |
| 2-Methyl-2-nonadecanol | 44 –45 |
| 1,1-Diphenyl octadecanol | 58 |
| 4-Methylbenzyl alcohol | 59 – 60 |
| Phenyl 4-tolyl carbanol (4-methylbenzhydrol) | 58 (42, 53) |
| Isofenchyl alcohol | 62 |
| Propyl benzyl alcohol | 49 |
| 3,3,5-Trimethylcyclohexanol | 55.8 |
| Diols | |
| 1,12-Octadecanediol | 66 – 67 |
| 1,10-Decanediol (decanmethylene glycol) | 72 – 75.5 |
| 3-(octadecyloxy)-1-2-propanediol (batyl alcohol) | 70 – 71 |
| α-Hexadecylglyceryl ether (chimyl alcohol) | 64 |

While any of the foregoing alcohols are useful as the crisping component in the compositions, processes and articles of manufacture of this invention, cetyl alcohol is especially preferred from the standpoint of excellent crispness and desirable skin emolliency benefits. Stearyl alcohol is also preferred from the standpoint of commercial availability. The fatty alcohol mixture derived from tallow carboxylic acids and commonly referred to as tallow-alkyl alcohol is preferred from the standpoint of cost and availability. Mixtures of these alcohols are also useful herein.

Carboxylic Acids and Salts

The substantially water-insoluble carboxylic acids and the substantially water-insoluble salts thereof having melting points as set forth above are also useful as the fabric crisping component of the compositions herein.

When selecting a carboxylic acid or carboxylate salt for use herein, the same considerations apply as to operable and preferred melting point ranges, water solubility, lack of color, non-hygroscopicity, etc., as in the case of the alcohol fabric crisping agents. As with the alcohols, all manner of water-insoluble aliphatic, aromatic, olefinic, aralkyl, heterocyclic, etc., carboxylic acids and salts are useful herein.

Fatty acids, synthetic or natural, especially the saturated fatty acids, are preferred herein because of their availability and price. Fatty acids are also recognized as skin emollients. Saturated fatty acids are preferred herein since they do not decompose at dryer operating temperatures.

Water-insoluble carboxylate salts, especially the salts of the $C_8$–$C_{20}$ fatty acids, are also useful herein. Such salts can be prepared by neutralizing the free acids with a metallo base, e.g., $Mg(OH)_2$, $Ca(OH)_2$, and the like, in well-known fashion. The cation of the base then becomes the cation of the carboxylate salts. Of course, it is preferred to use salts of non-toxic cations. Colorless carboxylate salts are preferred, and lack of color will dictate the selection of cation for use in the case of the most preferred carboxylates. The $Ca^{++}$ and $Mg^{++}$ carboxylate salts are preferred herein by virtue of low cost, ready availability, and the foregoing considerations.

Table II sets forth a selection of non-limiting examples of carboxylic acids which can be employed as the fabric crisping component herein. It is to be understood that the $Ca^{++}$ and $Mg^{++}$ salts of each of these listed acids are also useful for this purpose.

TABLE II

| | Mp °C |
|---|---|
| Dodecanoic acid | 44.2 |
| Tridecanoic acid | 41.5 |
| Tetradecanoic acid | 53.9 |
| Pentadecanoic acid | 52.3 |
| Hexadecanoic acid | 63.1 |
| Heptadecanoic acid | 61.3 |
| Octadecanoic acid | 69.6 |
| Nonadecanoic acid | 68.6 |
| Eicosanic acid | 75.3 |
| Heneicosanoic acid | 74.3 |
| 2-Propyloctadecanoic acid | 46 |
| 5-Methyloctadecanoic acid | 48 |
| 6-Methyloctadecanoic acid | 45 |
| 12-Methyltridecanoic acid | 53 |
| 15-Methyloctadecanoic acid | 43.5 |
| 2-Butyloctadecanoic acid | 50 |
| 2-Hexyloctadecanoic acid | 53.5 |
| 2-Nonyloctadecanoic acid | 47 |
| 2-Hexadecenoic acid | 57.5 |
| Trans-6-Octadecenoic acid | 54 |
| Trans-9-Octadecenoic acid | 46.5 |
| Phenylacetic acid | 76.5 |
| γ-Phenyl butyric acid | 52 |

It is to be recognized that the foregoing types of crisping agents can be combined to provide a range of tactile impressions on fabrics. For example, many of the fatty acid salts can provide a desirable lubricity reminiscent of talc when applied in combination with a fatty alcohol. Moreover, many of the fatty acid salts do not melt at ordinary dryer temperatures. Accordingly, it is desirable, from an efficiency standpoint, to mix such salts with the free acid or alcohol to provide a composition which melts and flows freely in the dryer.

Surfactant Component

The dryer added fabric conditioning compositions herein contain an oil-soluble surfactant component. This surfactant component helps disperse the fabric crisping component uniformly throughout the fabrics at dryer operating temperatures.

Although the compositions herein are applied to wet fabrics, which are subsequently dried, water-soluble surfactants do not serve to efficiently and uniformly disperse a fabric crisping component used in combination therewith. Moreover, while not intending to be limited by theory, it appears that water-soluble surfactants permit hydrogen bonding between the individual fabric fibers, thereby creating a rough, scratchy feel. Furthermore, the oil-soluble surfactants are substantially miscible with the substantially water-insoluble fabric crisping components thereby forming easily dispersed emulsions on contact with wet fabrics.

A general listing of oil-soluble surfactants useful herein appears in McCutcheon's "Detergents and Emulsifiers" North American Edition, 1973 Annual, incorporated herein by reference. In general terms, the oil-soluble surfactants useful herein have a hydrophilic-lipophilic balance (HLB) of 11, and below. That is to say, surfactants having a balance of hydrophilic and lipophilic characteristics such that they preferentially dissolve in hydrocarbyl materials (e.g., the fabric crisping component herein), rather than in water, are employed herein.

The selection of oil-soluble surfactants for use herein having low HLB's, i.e., about 2–11, can be made by reference to standard texts. Alternatively, the HLB's of various surfactants can be calculated in the manner set forth in Becker, "Emulsions Theory and Practice," Reinhold 1965, pp. 233–248. For example, for the normal alcohol ethoxylates which are a preferred class of surfactants herein, the equation $$HLB = E/5$$

where E is the weight percentage of oxyethylene content, can be used to calculate the HLB's.

Particularly useful and preferred oil-soluble surfactants herein include the nonionic alkoxylates of the general formula $$R-O-(C_yH_{2y}O)_a-(C_zH_{2z}O)_b-C_wH_{2w}OH$$

where R is selected from the group consisting of primary, secondary, and branched chain alkyl hydrocarbyl moieties; primary, secondary and branched chain alkenyl hydrocarbyl moieties; and primary, secondary and branched chain alkyl-and alkenyl-substituted phenolic hydrocarbyl moieties; said hydrocarbyl moieties having a hydrocarbyl chain length of from about 8 to about 20, preferably 10 to 16 carbon atoms. In the general formula for the alkoxylated nonionic surfactants herein, $y$ and $z$ are each integers from 2 to about 3, preferably 2, and $a$ and $b$ are usually integers from 0 to about 8, the sum of $a + b$, commonly being in the range of from about 3 to about 7, preferably 3 to 5. In the formula, $a$ and $b$ can be varied with the hydrocarbyl moiety, so long as the HLB remains at 11, or below. The formula of the surfactants herein encompasses ethylene oxide (EO) as well as propylene oxide (PO) and mixed (EO—PO) alkoxylates, all of which are oil-soluble and useful herein.

The preferred nonionic alkoxylated surfactants herein are further characterized by an HLB of about 2 to about 11, most preferably about 7 to about 9.

Specific examples of nonionic alkoxylated surfactants useful herein are as follows. These examples are only by way of exemplification and are not intended to be limiting of such materials.

Straight-Chain, Primary Alcohol Alkoxylates

The alkoxylates of hexa-, hepta-, octa-, nona-, deca-, undeca-, dodeca-, tetradeca-, and hexadeca-alcohols having an HLB within the range recited herein are useful surfactants in the context of this invention; the respective ethylene oxide condensates are the most preferred alkoxylates in this context. Exemplary ethoxylates are n-$C_{10}$EO(3), n-$C_{12}$EO(4) and n-$C_{10}$EO(3)PO(3). The lower ethoxylates of mixed natural or synthetic alcohols in the "coconut" chain length range are also useful herein. Specific examples of such materials include coconutalkyl EO(3) and coconutalkyl EO(5).

Straight-Chain, Secondary Alcohol Alkoxylates

The alkoxylates of 2-decanol, 2-tetradecanol, 3-hexadecanol, 2-octadecanol, 4-eicosanol, and 5-eicosanol having an HLB within the range recited herein are useful surfactants in the context of this invention; the respective ethoxylate condensates are the most preferred alkoxylates. Exemplary alkoxylated secondary alcohols useful herein as the surfactant component are: 2-$C_{10}$EO(4), 2-$C_{12}$EO(4), 2-$C_{14}$EO(6), 2-$C_{16}$EO(6), 4-$C_{20}$EO(8), 2-$C_{16}$EO(8) and 2-$C_{10}$EO(3)PO(3). The most preferred straight chain, secondary alcohol alkoxylates useful in this invention are marketed under the tradename Tergitol 15-S-3. Tergitol 15-S-3 comprises a mixture of secondary alcohols having an average hydrocarbyl chain length of 13 carbon atoms condensed with an average of 3 moles of ethylene oxide per mole of alcohol. Tergitol 15-S-5, i.e., the corresponding penta-ethoxylate, is also useful herein.

Alkyl Phenolic Alkoxylates

As in the case of alcohol alkoxylates, the alkoxylates of alkylphenols, particularly monohydric alkylphenols, having an HLB within the range recited herein are useful as the surfactant component of the instant invention. The ethylene oxide condensates are the most preferred alkoxylates. Most preferred are the tri- and tetra-ethoxylates of p-octyl phenol and p-nonyl phenol, inasmuch as these materials are readily available.

Exemplary alkoxylated alkyl phenols useful as the surfactant component of the mixtures herein are: p-octylphenol EO(3), p-nonylphenol EO(5) and p-decylphenol EO(4).

Olefinic Alkoxylates

The alkenyl alcohols, both primary and secondary, and alkenyl phenols corresponding to those disclosed immediately hereinabove can be alkoxylated to an HLB within the range recited herein and used as surfactant component of the instant compositions. Typical alkenyl alkoxylates herein are 2-n-dodecenol EO(6), 3-n-tetradecenol EO(3), p-(2-noneyl)phenol EO(4-)PO(2) and 2-tetradecen-4-ol EO(4).

Branched Chain Alkoxylates

Branched chain primary and secondary alcohols are available from the well known "OXO" process and can be alkoxylated and employed as the surfactant component herein. Exemplary branched-chain alkoxylates are as follows: 2-methyl-1-dodecanol EO(6); 3-ethyl-2-tetradecanol EO(4); 2-methyl-1-hexadecanol EO(6-)PO(2) and the like.

Processing

The compositions herein are prepared by simply combining the fabric crisping component and the surfactant component. Of course, it is desirable that the compositions be homogeneous. Homogeneous compositions can be conveniently secured by simply co-melting the two components, with agitation. In this manner, uniform dispersions, or true solutions, of the two components are obtained.

Useful fabric conditioning compositions have ratio ranges of from about 1000 parts by weight of crisping component: 1 part by weight oil-soluble surfactant, to 1:1 mixtures of these components. Surfactant:crisping component ratios above 1:1 are not useful since the fabric crisping effect is virtually lost in the presence of such high surfactant concentrations. Moreover, most oil soluble surfactants useful herein are liquid or pasty at ambient temperatures. Extremely high use levels of such surfactants make the fabric conditioning compositions undesirably pasty or oily.

A preferred weight ratio range of the components herein is from about 50:1 to about 4:1 (crisping component: surfactant component). Over this range the major amount of fabric crisping component present in the composition provides an effective fabric crisping function, while the minor, but substantial, amount of oil-soluble surfactant contributes a fabric softening and lubricity benefit in addition to dispersing the fabric crisping component throughout the fabrics during the drying operation.

Highly preferred compositions herein comprise from about 80% to about 95% by weight of fabric crisping component and from about 5% to about 15% by weight of oil-soluble surfactant component. Such compositions wherein the fabric crisping component comprises a fatty alcohol and wherein the surfactant comprises a nonionic, ethoxylated alcohol or alkylphenol are especially preferred.

Optional Components

The fabric conditioning compositions herein can contain minor proportions (i.e., 0.1% to about 15% by weight) of various optional ingredients which provide additional fabric conditioning benefits. Such optional ingredients include perfumes, anti-static agents, fumigants, bacteriocides, fungicides, flame retardants, and the like. Specific examples of typical additives useful herein can be found in any current Year Book of the American Association of Textile Chemists and Colorists. Such additional components are compatible with the oil-soluble surfactant and fabric crisping agents used herein.

Particularly useful optional ingredients herein include the $C_8$–$C_{20}$ amines, imidazolines, and quaternary ammonium salts widely recognized for use as anti-static agents. Specific examples of such materials include the mixed tallowalkyl amines, di-tallowalkyldimethylammonium chloride, and the coconutalkyl amides.

Anti-static materials are employed herein in effective, i.e., static-controlling, amounts. The actual amount used depends on a number of factors such as dryness of the climate and season of the year. In dry climates, higher amounts of static control agents are necessary in comparison with damp climates. In general, anti-static agents are used in concentrations of from about 0.1% to about 10% by weight of the total compositions herein.

Other optional components herein can be, for example, various alcohols, amides and the like which are fluid or waxy at room temperature. By using more or less of such materials, the crispness of fabrics can be modified over a spectrum of tactile impressions. As examples of such optional ingredients there can be mentioned lauryl alcohol and mixed coconutalkyl alcohols.

Dispensing Means

The instant fabric crisping compositions can be employed by simply adding a measured amount into the dryer. However, in a preferred embodiment, the compositions herein are provided as an article of manufacture in combination with a dispensing means which effectively releases the compositions in an automatic clothes dryer. Such dispensing means can be designed for single usage or for multiple uses.

One such article comprises a sponge material releasably enclosing enough fabric conditioning composition to effectively impart fabric crispness during several cycles of clothes. This multi-use article can be made by filling a hollow sponge with about 20 grams of the present compositions. In use, the compositions melt and leach out through the pores of the sponge to provide fabric crispness. Such a filled sponge can be used to impart fabric crispness to several loads of fabrics inconventional dryers, and has the advantage that it can remain in the dryer after use and is not likely to be misplaced or lost.

Another article comprises a cloth or paper bag releasably enclosing the fabric conditioning composition and sealed with the hardened fabric conditioning composition. The action of the dryer opens the bag and releases the fabric conditioning composition therein.

A highly preferred article herein comprises the fabric crisping component releasably affixed to the surface of a sheet of paper or woven or non-woven fabric substrate such that the action of the automatic dryer removes the fabric conditioning component and deposits it on the fabrics. As before, the fabric crisping component is most preferably employed as a composition containing an oil-soluble surfactant, as disclosed above.

The sheet conformation has several advantages. First, effective amounts of fabric conditioning compositions for use in conventional dryers can be easily affixed to the substrate by a simple dipping or padding process. Second, the user need not measure the amount of material necessary to obtain fabric crispness. Additionally, the relatively flat, thin coating of the fabric crisping composition on the sheet is effectively released onto the fabrics.

More specifically, the water-insoluble paper, or woven or non-woven substrates used in the preferred articles herein can have a dense, or more preferably, open or porous structure. Examples of suitable materials which can be used as substrates herein include paper, woven cloth, and non-woven cloth. The term "cloth" herein means a woven or non-woven substrate for the articles of manufacture, as distinguished from the term "fabric" which encompasses the clothing fabrics being dried in an automatic dryer.

The paper, woven or non-woven substrates useful herein are fully disclosed in U.S. Pat. No. 3,632,396, incorporated herein by reference.

As noted above, the preferred articles herein can be manufactured by a simple dipping or coating procedure. In a typical procedure, the crisping component comprising the alcohol, carboxylic acid, carboxylate salt or mixtures thereof, is mixed with the oil-soluble surfactant and warmed in a trough to form a fluid melt. The insoluble substrate is fed through the melt and the fabric conditioning composition coats and impregnates the substrate. The substrate is removed from the trough and the fabric conditioning composition solidifies on the substrate. By controlling the type of substrate and the speed of the substrate through the trough, an effective amount of fabric conditioning composition is affixed to a predetermined length and width of substrate.

The preferred articles herein are provided as 10 in. × 11 in. substrate sheets coated with from about 2 g. to about 8 g. of the fabric treatment compositions. Such articles provide sufficient fabric treatment composition to impart a crisp feel to an average 5 lb. dryer load of wet fabrics.

A particularly useful and preferred article of manufacture herein employs, as the fabric treatment composition, from about 80% to about 95% (wt.) of a fabric crisping component, from about 5% to about 15% (wt.) of oil-soluble surfactant component and from about 2% to 8% (wt.) of an anti-static agent, especially tallowalkyl amine. From about 0.1% – 1.2% (wt.) of perfume is commonly employed in such compositions to provide a pleasant aesthetic effect.

Composition Usage

In the process aspect of this invention the alcohols, carboxylic acids, carboxylate salts or mixtures thereof are used in an effective amount to impart fabric crispness in an automatic dryer. From about 1 gram to about 12 grams, preferably 2.5 g. to 6 g. of the fabric crispness component constitutes an amount effective to impart fabric crispness to an average 5 lb. load of fabrics in a standard home dryer. More or less of the crisping component can be used, but amounts greater than about 12 g./5 lb. fabric load can result in undesirable staining and are usually avoided. As noted, the fabric crisping component is effective when used singly, but is preferably employed in the dryer in combination with an oil-soluble surfactant.

In practice, the wet fabrics to be dried are placed in the dryer and are contacted with an effective amount of the compositions herein. It is convenient to simply add one of the above-described articles containing a premeasured amount of the compositions to the dryer. The dryer is operated in standard fashion, usually at a temperature over a range of from about 38° C to about 80° C, to dry the fabrics and to impart a clean, crisp feel thereto.

The following examples illustrate the compositions, processes and articles of this invention, but are not intended to be limiting thereof.

EXAMPLE I

A fabric crisping composition adapted for use in an automatic dryer is as follows.

| Ingredient | Weight % |
|---|---|
| Cetyl Alcohol | 84 |
| Tergitol 15-S-3 | 10 |
| Tallowalkyl Amine* | 5 |
| Perfume | 1 |

*Anti-static ingredient

The foregoing ingredients are heated to a temperature of 60° C whereby a homogeneous liquidified mass is obtained. The mass is allowed to solidify at room temperature and is then granulated to provide homogeneous particles of an average diameter in the range of from about 20 microns to about 35 microns.

4.5 Grams of the foregoing particulate composition are added to a standard, automatic, rotary drum dryer containing 5 lbs. of freshly washed, damp fabrics. The dryer is allowed to operate over its normal temperature cycle, i.e., beginning at about 24° and ending at about 77° C. After drying, the fabrics are found to exhibit a soft, yet crisp, non-greasy feel. The crisp feel is especially notable on cotton terry towels and other cotton fabrics.

In the above composition the cetyl alcohol is replaced by an equivalent amount of a 1:1:1 (wt.) mixture of cetyl alcohol, tallowalkyl alcohol, myristyl alcohol. The other ingredients and procedures remain the same. A modified crispness aspect characterized as a less dry, more lubricious, sensation is provided to the dried fabrics.

In the foregoing composition the Tergitol 15-S-3 is replaced by an equivalent amount of Plurofac A-24 (an oxyethylated straight chain alcohol with an HLB of 6.0 available from BASF-Wyandotte) and equivalent results are secured.

The compositions of Example I are especially advantageous in that they control static electricity on the dried fabrics.

EXAMPLE II

| Ingredient | Weight % |
|---|---|
| Cetyl Alcohol | 90 |
| Tergitol 15-S-3 | 10 |

The ingredients are heated to a temperature of about 60° C, whereby a homogeneous, liquefied mass is obtained. The mass is allowed to solidify at room temperature and is granulated with a mortar and pestle to an average particle size of about 100 microns.

9.5 Grams of the granulated composition of Example II are sprinkled onto 6 lbs. of freshly washed, wet fabrics. The fabrics are placed in an automatic dryer and dried at about 67° C. Effective fabric softening/crisping is obtained.

The foregoing procedure is modified by removing the Tergitol surfactant from the composition. The pure cetyl alcohol effectively crisps the dried fabrics, but is not uniformly distributed over all fabric surfaces. The softness aspect noted when the Tergitol is present in the compositions is somewhat diminished.

In the above composition the cetyl alcohol is replaced by 99% (wt.) stearyl alcohol and the Tergitol is replaced by 1% (wt.) of a surfactant comprising nonylphenol condensed with 4 moles ethylene oxide (HLB 6.2). Effective fabric softening and crisping is secured when this modified composition is applied to damp fabrics, which are subsequently dried at 65° C.

EXAMPLE III

An article of manufacture comprising a fabric crisping and anti-static composition releasably affixed to a non-woven cloth substrate and adapted for use in an automatic dryer is as follows:

| Composition | |
|---|---|
| Ingredient | Weight % |
| Cetyl Alcohol | 84 |
| Tergitol 15-S-3 | 10 |
| Tallowalkyl Amine | 5 |
| Perfume | 1 |
| Substrate | |
| Non-woven rayon, 3-denier, ca. 11 inches wide. | |

The cloth substrate is mounted on a tubular roll and a rod is passed through the core and positioned to allow the cloth to unroll when pulled.

The Composition is heated to 60° C in a trough to provide a homogeneous melt. The substrate is pulled through the trough at a rate of about 50–60 feet per minute and further passed through a pair of rollers which are adjusted to remove excess molten Composition from the substrate.

The speed of the substrate passing through the trough and the pressure of the pair of rollers is adjusted so that 4–5 grams of the Composition are deposited per 110 in.$^2$ of substrate. The substrate is perforated every 10 inches to provide easy separation into sheets having 4–5 g. of the Composition on each sheet. The article is allowed to cool to room temperature, whereby the molten Composition solidifies. The final article remains flexible.

An article prepared in the foregoing manner having a total surface area (both sides) of 220 in.$^2$ is added to a home dryer containing 5 lbs. of wet clothes. The dryer is operated at an average temperature of 67° C to dry the fabrics. The fabrics are provided with a soft, crisp, anti-static finish.

The foregoing illustrates the commerical advantage of the sheet substrates herein in that production speeds of 500–600 linear feet of substrate/minute, and greater, can be treated with the composition herein. Moreover, the compositions do not foam. Foaming encountered in the preparation of dryer-added fabric treating articles employing high levels of guaternary ammonium salts, as disclosed in the prior art, can cause substantial processing problems in high speed production lines.

EXAMPLE IV

An article of manufacture especially adapted for use in an automatic dryer is as follows:

| Composition | |
|---|---|
| Ingredient | Weight % |
| Tridecanoic acid | 50 |
| Myristyl alcohol | 25 |
| Magnesium hexadecanoate | 10 |
| Di-tallowalkyl dimethyl-ammonium chloride | 10 |
| Tergitol 15-S-5 | 4 |
| Perfume | 1 |
| Substrate | |

-continued

| |
|---|
| Paper toweling, 2-ply, 10 in. × 11 in. |

The Composition is prepared by admixing the several ingredients and warming to form a fluid melt. The magnesium hexadecanoate is not totally melted at temperatures below about 60° C but exists as a homogeneous dispersion of particles of an average size of about 25 microns throughout the melt. The molten material is simply padded onto the paper substrate at a rate of 6 g./110 in.$^2$, and allowed to dry at room temperature to provide an article suitable for use in an automatic dryer.

The foregoing article, 110 in.$^2$, is placed in an automatic dryer containing damp clothing and the dryer is operated at an average temperature of 65° C. Upon drying, the fabrics are provided with a crisp, lubricious, feel. The static electrical charges on the fabric surfaces are found to be minimal.

In the foregoing Composition the tridecanoic acid is replaced by an equivalent amount of tetradecanoic acid, hexadecanoic acid, and heptadecanoic acid, respectively, and equivalent results are secured.

In the foregoing Composition the magnesium hexadecanoate is replaced by an equivalent amount of calcium octanoate, magnesium tridecanoate, and magnesium eicosanoate, respectively, and equivalent results are secured.

In the foregoing Composition the Tergitol 15-S-5 is replaced by an equivalent amount of Ethomeen T/12 (Armak Co. HLB 4.5; diethoxylate of tallow tertiary amine); sorbitan monopalmitate (HLB 6.7); and sorbitan monostearate (HLB 4.7), respectively, and equivalent results are secured.

As can be seen from the foregoing examples, the compositions herein are suitable for imparting a fabric crispness aspect when employed in a variety of ways. From a commerical standpoint, it is, of course, important that such compositions be prepared using the most economical starting materials. For example, as disclosed hereinabove, various alcohol mixtures are attractive for use herein, inasmuch as such mixtures are not as expensive as their pure alcohol components. Surprisingly, it has been found that paraffin, i.e., the well-known waxy material which comprises mixed chain length, substantially saturated, inert hydrocarbons, can be employed herein as a diluent for the fabric crisping component. Paraffin wax, which melts over a range of about 50° C to 57° C, is cheaper than the fabric crisping components herein and its use in combination therewith is economically attractive. Although paraffin wax, is, of course, "waxy," it has been found that when used as a diluent for the fabric crisping components herein, controlled amounts of paraffin do not substantially detract from the crispness aspect imparted to fabrics treated therewith. As a result, fabric crisping components which comprise the hereinabove-disclosed alcohols, carboxylic acids and carboxylate salts containing up to about 25% by weight of paraffin can be employed in the manner of this invention to provide fabric crispness. Most preferably and economically, fabric crisping components comprising from about 75% to about 90% by weight of an alcohol, carboxylic acid or carboxylate as set forth hereinabove and from about 10% to about 25% by weight of paraffin can be thus employed.

The following is an example of a fabric treatment composition and article herein wherein the alcohol fabric crisping component is diluted with paraffin.

EXAMPLE V

| Ingredient | Weight % |
|---|---|
| Cetyl Alcohol | 75 |
| Paraffin Wax | 10 |
| Tallowalkyl Amine | 10 |
| Tergitol 15-S-3 | 5 |

The foregoing composition is prepared by admixing the ingredients at 60° C to provide a homogeneous melt. The melt is sprayed onto a paper substrate at a rate of 5 grams/100 in.$^2$ and allowed to cool, thereby providing an article suitable for use in an automatic clothes dryer.

The article prepared in the foregoing manner is added to an automatic dryer and 5 lbs. of wet clothes are added thereto. The dryer is operated at 65° C until the clothes are completely dry. Upon removal from the dryer, the clothes are found to have a crisp, lubricious, non-tacky, anti-static feel.

In an alternate procedure, the composition of Example V is sprayed directly onto the wet clothes at a rate of 6 g./5 lbs. of fabric from an aerosol container. After drying in the dryer, the clothes are provided with a crisp, non-tacky, lubricious, anti-static finish.

In the foregoing composition, the Tergitol 15-S-3 is replaced by an equivalent amount of Arosurf 160-E2 (HLB 8.2; Ashland Chemical Co.; ethoxylated coco amine); sodium stearoyl-2-lactylate (HLB 5–7; as Emplex, available from Patco Products); and sodium lauroyl lactylate (HLB 7–9; as R-138C, also available from Patco Products), respectively, and equivalent results are secured.

In an alternative procedure, waxy esters having a melting point of about 38° C, and higher, preferably from about 45° C to about 65° C, can be employed in combination with the fabric crisping components herein. As in the case of the paraffin wax, such waxy ester materials are cheaper than the alcohols and acids herein and provide an economically attractive product. Moreover, when used as a diluent for the fabric crisping components herein, controlled amounts of waxy esters provide an unusual and desirable tactile stimulus when applied to fabrics. More specifically, fabrics treated in the manner of this invention with the fabric crisping components herein containing controlled amounts of waxy esters exhibit a crisp feel immediately upon removal from the dryer. After standing at ambient conditions, the crisp connotation of the fabric feel gives way to a soft, lubricious feel akin to that achieved with standard fabric softeners employing quaternary ammonium compounds.

Fabric crisping components which comprise the hereinabove-disclosed alcohols, carboxylic acids and carboxylate salts containing up to about 60% by weight of waxy esters can be employed in the manner of this invention to provide a modified fabric crisping aspect. Most preferably and economically, fabric crisping components comprising from about 40% to about 90% by weight of an alcohol, carboxylic acid or carboxylate salt as set forth hereinabove and from about 10% to about 60% by weight of a waxy ester having a melting point within the range set forth can be thus employed.

The waxy esters which are useful as an adjunct to the fabric crisping components herein include the mono-, di- and tri-glyceride carboxylic acid esters, as well as mixtures of such materials. Such esters are available as the naturally-occurring mixtures of higher carboxylic acid esters, and are usually classified on a basis including source, physical properties and chemical properties. For example, waxes have been defined as anything with a waxy feel at a melting point above body temperature and below the boiling point of water. More specifically, waxes are defined as esters of higher molecular weight monohydric alcohols with the common higher fat acids. Examples of such materials include carnauba wax, ouricuri wax, beeswax, spermaceti, and degras.

Fats and oils comprise esters of higher fatty acids and the trihydric alcohol, glycerol. The term "fat" is generally reserved for the higher melting glycerides, which may be mixtures of mono-, di- and tri-glycerides. Useful fats herein include coconut fat, babassu fat, palm fat, butter fat, lard fat, and tallow fat.

Oils are usually mono-, di-, and tri-glycerides of unsaturated and short-chain carboxylic acids. While the low-melting oils can be employed herein, their use results in an undesirable greasy feel when applied to fabrics. However, the commonly available oils can be hydrogenated at the points of unsaturation, and thereby "hardened" in well-known manner to provide materials which have melting points within the range exhibited by the fats. Such hydrogenated oils having melting points within the range set forth hereinabove are also useful herein. As examples of such materials there can be mentioned the following hydrogenated oils: castor, olive, peanut, rapeseed, corn, sesame, cottonseed, soybean, sunflower, hemp, linseed, tung, oitica, lard, neat's-foot, whale and fish oils.

While the foregoing sets forth various naturally-occuring fats, waxes and hydrogenated oils useful herein, it is well recognized that such materials can be made by simple esterification reactions, and it is not intended to limit the disclosures herein to such naturally-occurring materials. In short, any of the waxy ester materials having a melting point within the recited range can be employed in combination with the fabric crisping component herein to provide useful fabric treatment compositions adapted for use in an automatic dryer.

Highly preferred waxy adjunct materials herein include tallow fat, coconut fat and palm fat; tallow fat is especially preferred from the standpoint of cost, availability, and melting point within the preferred range.

The following is an example of a fabric treatment composition and article herein wherein the alcohol fabric crisping component is employed in admixture with a waxy ester material.

EXAMPLE VI

| Ingredient | Weight % |
|---|---|
| Composition | |
| Tallowalkyl alcohol | 89.0 |
| Beef tallow | 10.0 |
| Perfume | 1.0 |
| Substrate | |
| Non-woven rayon, 3 denier, ca. 11 inches wide. | |

The composition of Example VI is prepared and applied to the substrate in the manner disclosed in Example III, above, to provide an article suitable for use in an automatic dryer.

An article (110 in.$^2$) prepared in the foregoing manner containing 5 g. of the Composition is added to a home dryer containing 5 lbs. of damp clothes. The dryer is operated at an average temperature of 67° C to dry the clothes. The clothes are provided with a crisp feel, which slowly changes to a soft, lubricious feel.

The foregoing Composition is replaced by a mixture comprising 74% tallowalkyl alcohol, 10% beef tallow, 10% Tergitol 15-S-3, 5% tallowalkyl amine anti-stat and 1% perfume. The mixture (5 g.) is applied to 110 in.$^2$ of Substrate and placed in a dryer with 5 lbs. of damp cotton terry towels. The towels are dried at 67° C and are provided with a crisp, anti-static finish over the whole of the towel surfaces. The crisp finish gives way to a soft, lubricious feel on storage at ambient temperature.

In the foregoing Composition the beef tallow is replaced by an equivalent amount of hardened soybean oil, hardened cottonseed oil, hardened peanut oil and hardened castor oil, respectively, and equivalent results are secured.

In the foregoing article, 0.1 g. of tallowalkylamine is deposited on the substrate per 220 in.$^2$ of surface area in conjunction with the Composition. The resulting article provides an anti-static effect on fabrics when used in an automatic dryer.

As can be seen from the foregoing, a wide variety of alcoholic materials can be employed in the compositions, processes and articles of manufacture of the present invention. Another type of material which can be classified as an alcohol and which can be employed as the alcohol component of the aforesaid compositions, processes and articles encompasses various esters of polyhydric alcohols. Such ester-alcohol materials which have a melting point within the range recited herein and which are substantially water-insoluble can be employed herein when they contain at least one free hydroxyl group, i.e., when they can be classified chemically as alcohols. Such materials meet the requirements of the alcohols employed herein, and it is intended that the term "alcohol" encompasses such —OH containing ester-alcohol materials. This class of materials includes, for example, the mono- and di-esters of glycerol, such as are obtained from the oils and fats set forth immediately hereinabove. The glycerol di-esters are particularly useful herein, inasmuch as they contain the requisite free hydroxyl group for bonding with fabric surfaces, are water-insoluble and can be selected to have melting points within the required and preferred ranges herein. Finally, such di-esters of glycerol are available from commercial fats and waxes and are known to be toxicologically acceptable.

The alcoholic di-esters of glycerol preferred for use herein include both the 1,3-di-glycerides and the 1,2-di-glycerides. It is to be recognized that, inasmuch as glycerides containing one, or more, free hydroxyl groups are properly classifiable as alcohols, such materials can be employed as the whole of the fabric crisping component herein. Alternatively, the glycerides can be mixed with paraffin, triglycerides, and the like, as set forth hereinabove, to provide a spectrum of tactile stimuli on the fabrics. In particular, di-glycerides containing two $C_8$–$C_{20}$, preferably $C_{10}$–$C_{18}$, alkyl groups in the molecule provide a soft handle to fabrics which is reminiscent of the effect achieved with the di-long chain alkylammonium fabric softeners in common use. It has been found that the di-long chain alkyl groups in such di-ester alcohols provide a soft, lubricious feel when these materials are employed as the fabric treating agents herein. As in the case with the alcohols such as cetanol and the like, it is preferred to employ the aforesaid ester-alcohols in combination with an oil-soluble surfactant in the same ratios and proportions disclosed above. Again, the various optional adjuvant materials such as the anti-static agents and the like can optionally be employed with such ester-alcohols.

Mono- and di-ether alcohols, especially the $C_{10}$–$C_{18}$ di-ether alcohols having at least one free-OH group also fall within the definition of alcohols useful herein and can be similarly employed as the fabric crisping component.

The ester-alcohols employed herein can be synthetically produced in well-known fashion by esterifying a poly-ol with an amount of a carboxylic acid or anhydride such that one, or more, of the —OH groups remain unesterified. For example, reacting one mole of glycerol (3-OH groups) with 2 moles of lauric acid provides mixtures of 1,2- and 1,3-dilauryl esters of glycerol. Such mixtures can be separated if desired, but the mixtures, themselves, are suitable for use herein. In like manner there can be produced 1,2- and 1,3-dimyristic, di-palmitic and di-stearic acid esters of glycerol. Mixed tallow fatty acids can also be employed to prepare mixed esters and are economically attractive.

The ether-alcohols useful herein can be prepared by the classic Williamson ether synthesis. As with the ester-alcohols, the reaction conditions are chosen such that at least one free, unetherified —OH group remains in the molecule.

The ester-alcohols are preferred for use herein over the ether-alcohols due to their availability and known toxicological acceptability.

Non-limiting examples of ester-alcohols useful herein include: glycerol-1,2-dilaurate, glycerol-1,3-dilaurate, glycerol-1,2-myristate, glycerol-1,3-dimyristate, glycerol-1,2-dipalmitate, glycerol-1,3-dipalmitate, glycerol-1,2-distearate and glycerol-1,3-distearate. Mixed glycerides available from mixed tallowalkyl fatty acids, i.e., 1,2-ditallowalkyl glycerol and 1,3-ditallowalkyl glycerol, are economically attractive for use herein. The foregoing ester-alcohols are preferred for use herein due to their ready availability from natural fats and oils.

Other ester-alcohols useful herein include glycerol-1-stearate-2-palmitate, butane tetra-ol-1,2,3-tristearate, sorbitol tristearate and the like.

Ether-alcohols useful herein include glycerol-1,2-dilauryl ether, glycerol-1,3-distearyl ether, and butane tetra-ol-1,2,3-trioctanyl ether.

The following is an example of an article of manufacture which is especially adapted to providing a soft, lubricious feel to fabrics in an automatic dryer.

EXAMPLE VII

| Ingredient | Weight % |
|---|---|
| **Composition** | |
| Di-myristin* | & 84 |
| Tergitol 15-S-3 | 10 |
| Tallowalkyl Amine** | 5 |
| Perfume | 1 |
| **Substrate** | |

EXAMPLE VII-continued

Non-woven rayon, 3 denier, ca. 11 inches wide.

*Glycerol-1,3-dimyristate.
**Anti-stat marketed as Adogen 140.

The composition of Example VII is prepared and applied to the substrate in the manner disclosed in Example III, above, to provide an article suitable for use in an automatic dryer.

The article of Example VII (110 in.$^2$ Substrate; 5 g. Composition) is placed in automatic dryer and 5 lbs. of damp clothes are placed therein. The clothes are dried at an average temperature of 67° C and are provided with a soft, lubricious, anti-static finish.

In the foregoing example, the di-myristin is replaced by an equivalent amount of 1:1 (wt.) mixture of glycerol-1,3-distearate, glycerol-1,3-dipalmitate and glycerol-1-stearate, respectively, and equivalent results are secured.

In an alternate procedure, 5 g. of the Composition of Example VII are sprinkled uniformly onto 5 lbs. of damp fabrics. The fabrics are dried at 80° C and are provided with a soft, anti-static feel.

As can be seen from the foregoing, the compositions herein are formulated using components which are specifically designed for use in automatic dryers. The compositions can be selected to provide a spectrum of tactile sensations, according to the desires of the user. For example, a crispness aspect can be provided by means of alcohols such as cetyl alcohol and the other fatty alcohols. At the other end of the spectrum, a soft, lubricious feel can be provided by means of the various ester-alcohols disclosed herein. As an intermediate position, a crisp, yet soft, lubricious feel can be provided by means of fatty alcohol compositions containing up to about 60% by weight of triglycerides. Inexpensive compositions which provide a desirable tactile sensation on fabrics can be provided by the use of the alcohols set forth herein containing up to about 25% of their weight of paraffin wax. The most highly preferred compositions herein contain at least about 60% by weight of any of the aforesaid fabric crisping/treating components in combination with an oil-soluble surfactant which provides uniform distribution of the compositions over the fabric surfaces. For convenience, articles are provided which release the compositions at dryer operating temperatures. Such articles can be designed to deliver an effective amount, i.e., from about 1 g. to about 6 g., of the compositions herein per average (5–7 lbs.) dryer load. The compositions are useful in standard, home automatic dryers which operate at average temperatures of about 67° C, as well as in commercial and hospital dryers, which operate at temperatures nearer 100° C. Fabrics treated within the manner of this invention can impart a smooth, emollient feel to skin in contact therewith. In contrast with many fabric finishing agents, the compositions herein do not substantially detract from the water absorbing properties of the treated fabrics.

What is claimed is:

1. An article of manufacture adapted to be added to an automatic dryer, comprising:

a. a fabric conditioning composition comprising a substantially homogeneous mixture of:

i. a substantially water-insoluble fabric crisping component selected from the group consisting of alcohols, carboxylic acids, carboxylic acid salts, and mixtures thereof, said crisping component having a melting point of at least about 38° C; and ii. an oil-soluble surfactant component selected from the group consisting of nonionic ethoxylated alcohols and nonionic ethoxylated alkyl phenols having an HLB of from about 7 to about 9; wherein said crisping component is co-present with said surfactant component at a weight ratio of from about 1000:1 to about 1:1; and b. a dispensing means for releasing an effective amount of said fabric conditioning composition at automatic dryer operating temperatures, said dispensing means being a sponge, cloth or paper bag, or woven or nonwove fabric substrate.

2. An article according to claim 1 wherein the crisping component is selected from the group consisting of cetyl alcohol, stearyl alcohol, tallowalkyl alcohol, glycerol-1,2-dilaurate, glycerol-1,3-dilaurate, glycerol-1,2-dimyristate, glycerol-1,3-dimyristate, glycerol-1,2-dipalmitate, glycerol-1,3-dipalmitate, glycerol-1,2-distearate, glycerol-1,3-distearate, 1,2-ditallowalkyl glycerol, 1,3-ditallowalkyl glycerol, 1,2-ditallowalkyl glycerol, and mixtures thereof.

3. An article according to claim 1 wherein the fabric conditioning composition is releasably contained within the dispensing means.

4. An article according to claim 1 wherein the dispensing means comprises a woven, non-woven or paper substrate having the fabric conditioning composition releasably affixed thereto.

5. An article according to claim 1 releasably containing an effective amount of an anti-static agent.

6. An article according to claim 1 wherein from about 10% about 25% by weight of the crisping component comprises paraffin wax.

7. An article according to claim 1 wherein from about 10% to about 60% by weight of the crisping component comprises a waxy ester having a melting point above about 38° C.

* * * * *